United States Patent [19]

Forestal

[11] 4,301,934

[45] Nov. 24, 1981

[54] NURSING BOTTLE DEVICE FOR NURSING AN INFANT

[76] Inventor: Robert J. Forestal, 6127 Wexford Rd., Indianapolis, Ind. 46220

[21] Appl. No.: 88,548

[22] Filed: Oct. 26, 1979

[51] Int. Cl.[3] ..... A61J 9/00

[52] U.S. Cl. ..... 215/11 D

[58] Field of Search ..... 215/11 D, 11 R, 11 B; 248/103

[56] References Cited

U.S. PATENT DOCUMENTS

| | | | |
|---|---|---|---|
| 159,197 | 1/1875 | Mason | 215/11 R |
| 236,583 | 1/1881 | Hayes | 215/11 D |
| 1,671,085 | 5/1928 | Nuernberg | 248/103 |
| 2,530,478 | 11/1950 | Parent | 248/103 |
| 3,945,524 | 3/1976 | Tkaciukas | 215/11 R |

*Primary Examiner*—Donald F. Norton
*Attorney, Agent, or Firm*—Robert A. Spray

[57] ABSTRACT

An infant's nursing bottle device, whose nipple is carried on a flexible tube and remote from the nursing bottle, with a support of the nursing bottle in an inverted position, providing convenient nursing of the milk by the infant having to locate and hold only the nipple means of the device, thus providing an infant's self-feeding arrangement for the infant's obtaining of the food from the nursing bottle, without a need for anyone to hold the bottle.

11 Claims, 5 Drawing Figures

NURSING BOTTLE DEVICE FOR NURSING AN INFANT

The present invention relates to a nursing bottle device for nursing an infant; and the inventive concepts hereof provide a nipple means carried on an elongated tube means which is connected to the nursing bottle which contains the milk supply.

The concepts further provide support means which supports the nursing bottle in an inverted position by support from any convenient support wall or abutment nearby; and this provides not only the desired orientation of the nursing bottle, but keeps it out of the infant's way so that all which the infant need be concerned with is the nursing nipple means itself. It further maintains the proper orientation of the bottle to get all the milk to flow therefrom and to maintain proper bottle position for operativity of an anti-burp valving device advantageously provided.

Nursing bottles have not apparently advanced in many respects through the years even though they have been used on many millions of occasions in many millions of households. Nursing of a baby from a bottle has long presented a problem, particularly when the demands of convenience or otherwise mean occasions in which the nursing bottle is to be not held by the parent. On such occasions, the nursing bottle is attempted to be propped up, by blankets or by some crib accessory such as a stuffed animal or toy, and/or the baby is left to maintain a proper orientation of the bottle.

In any of these methods of nursing bottle support, often the proper inverted position of the nursing bottle is not maintained, due to the weight or awkwardness of the nursing bottle to the baby, or to the unsturdiness of the propping means or to whatever other reason; and untold millions have then experienced the annoyance and inconvenience of the infant crying aloud until the proper bottle-position is again re-established.

Even then, sometimes a temporary stoppage of the disposition-contentment of the nursing procedure has so upset the infant that he or she refuses to begin nursing again, and instead, continues to wail.

The present invention advantageously avoids those many problems. That is, the bottle is sturdily supported in an out-of-the-way position, and in its proper inverted orientation. Only the relatively light weight and easily graspable nipple means need concern the infant. Advantageous valving means, economically provided in simple form as is permitted by the assurance of a constant-vertically inverted position of the nursing bottle, is provided, effectively shutting off the supply of air to be sucked from an empty bottle, avoiding the requirement of the baby needing to be burped, and crying and fretting until it is burped.

The above has been of rather introductory nature. More particular details, concepts, features, and advantages of the present invention are set forth in the more detailed description which follows, reference being had to the accompanying somewhat schematic drawings, in which.

Figure 1:
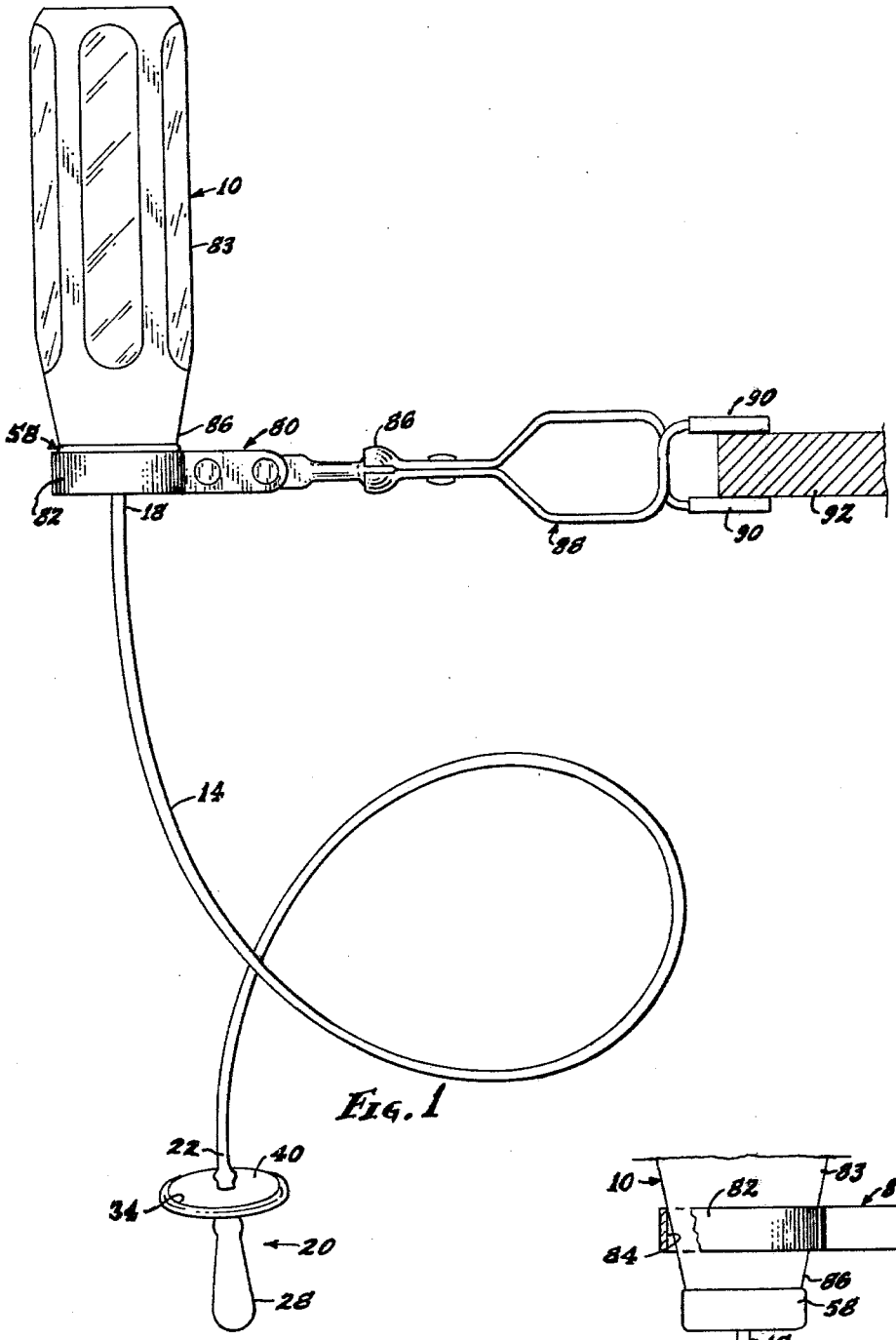
FIG. 1 is a pictorial side-elevation view of a nursing bottle device of the present invention.

As shown in the drawings, the concepts of the present invention provide an advantageous nursing bottle apparatus in the form of a remotely-supplied nipple device for an infant's nursing bottle 10.

In the form shown, the most conspicuous principal components of the device are a closure means 12 for the nursing bottle 10, an elongated flexible tube means 14 connected at one end 18 of the bottle's closure means 12, and a nipple means 20, to which the other end 22 of the tube 14 is connected.

More particularly, for the nipple means 20 there is provided first interconnection means 24 which connects the end 22 of the tube means 14 with the interior 25 of the nipple means 20, and thus provides communication of the interior 26 of the tube means 14 with the interior 27 of the nipple 28 of the nipple means 20.

Also, adjacent the nursing bottle 10, there is provided second interconnection means 30, which connects the end 18 of the tube means 14 with the nursing bottle 10, and provides communication of the interior 26 of the tube means 14 with the interior 32 of the nursing bottle.

The nipple means 20 is shown as providing for the nipple 28 (at its open end 34 opposite from its sucking tip 36 which has the milk outlet opening 38 at its outer end 39) a rigid circular disk 40.

The outer periphery or rim 42 of the disk 40 is sealingly engaged by the resilient material of the end 34 of the nipple 28, providing that the interior 25 of the overall nipple means 20 and the interior 27 of the nipple 28 itself comprise a closed chamber (25, 27) into which the milk is drawn through the tube 14 from the nursing bottle 10.

For sealingly and supportingly connecting the end 22 of the tube 14 to the nursing nipple means 20, the disk 40 is shown provided with a central opening 41 which carries an upstanding tube-mounting means shown as a tubular post 44 having a hollow interior 46.

The post 44 may be formed integrally with the disk 40 or affixed thereto, in a manner such that its hollow interior 46 is operatively aligned with the disk-opening 41, as desired.

In whatever way the post 44 may be formed, the outer cylindrical wall 48 of the post 44 is of a diameter to snugly receive the end 22 of the long connector tube 14, preferably just snug enough to firmly hold yet not so snug as to make attachment or detachment of the tube-end 22 of tube 14 from the post 44 difficult, such as for washing.

The second interconnection means 30 for the nursing bottle 10 is shown as including a disk 50 which is of a diametrical size to overlie the end 52 of the wall of the nursing bottle 10, yet small enough so as to be received in the interior 54 of the nursing botle's closure cap 58.

The cap 58 is shown of a conventional screw-on type, the interengaging threads of the cap 58 and nursing bottle 10 being indicated at 60. The central opending 61 of the closure cap 58 is the opening through which a feeding nipple extends in conventional nursing bottle devices.

Formed of a somewhat resilient material, the disk 50 serves as a gasket between the nursing bottle's cap 58 and the nursing bottle itself, and other functions now described.

The disk 50 is shown as provided centrally with an opening 62; and into the opening 62 there is affixed a hollow tube-mounting post 64 extending, when the disk 50 and closure cap 58 are assembled onto the bottle 10, through the closure cap's central opening 61.

The bottom 66 of the post 64 is of a size to sealingly and supportingly receive the upper end 18 of the long nipple-connector tube 14, that connection of tube-end 18 and post-bottom 66 being snug for tight holding yet not too snug or tight as to make attachment or detachment difficult, such as for washing; and similarly to the mounting post 44 of the nipple means 20, the bottle closure's mounting post 64 may be formed integrally with the disk means 50 if desired.

Further as to the connector post 64, it has a hollow bore 68 extending throughout its length, for milk-flow operativity herein apparent.

A valve means 69 is shown, for preventing the physiologically-distressing problem of the baby sucking air when the milk supply in the nursing bottle 10 is exhausted.

As shown, the valve means 69 comprises a disk 70 of light enough weight so as to float on the supply of milk in the nursing bottle 10; and to firmly seat it against the bottle-interior or inlet portion 72 of the post 64, so as to seal or close the tube 14 when the milk supply is gone, the bottom 74 (the face adjacent the cap 58, which face is the bottom when the nursing bottle 10 is being held in its baby-feeding position shown) of the disk 70 is shown provided with a smoothly-rounded bulbous protrusion or boss 76, and the adjacent portion 72 of the tubular post 64 is enlarged, in a manner such that some resilient deformation of the boss 76 and/or of the inlet end 78 of the tubular post 64 is required for the boss 76 to pass that post-end 78.

Thus the last sucking action of the baby, in getting the last portion of the bottle's milk supply, achieves a locking valve-closing actuation, by the sort of detent effect of the snapping of the disk-boss 76 past the post-end 78.

If desired, a protrusion 76 may be formed on the other face 79 of valve-disk 70, so that even if the valve-disk 70 happens to get turned over, there will be one of the protrusions 76 operatively facing the connection inlet 72 for valving purposes mentioned.

Figure 2:
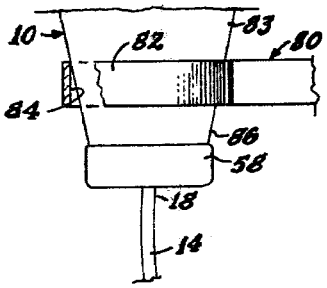
FIG. 2 is a fragmental detail view illustrating a bottle-holding means by which the nursing bottle is supported merely by inserting the nursing bottle into the bottle-holding means.
Figure 3:
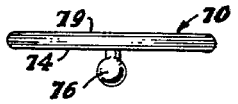
FIG. 3 is a side-elevational view of a valving member which is carried interiorly of the nursing bottle.
Figure 4:
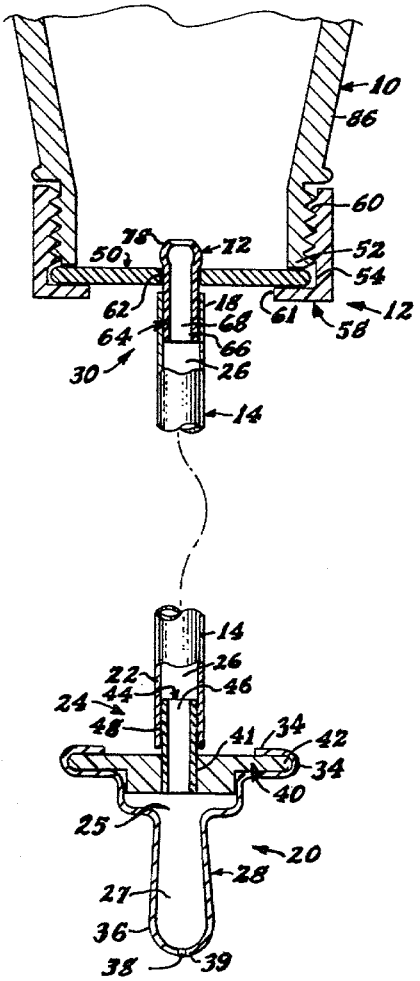
FIG. 4 is a fragmental detail cross-sectional view of the outlet portion of the nursing bottle, fitted with a cap enclosure means according to the present invention, and with a tube leading therefrom and connected to the remotely-carried nipple means.
Figure 5:
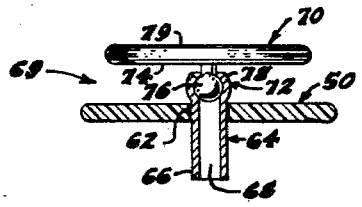
FIG. 5 is a detail view illustrating the valving closure of the tube which interconnects the nursing bottle with the nipple means.

The bottle-supporting means 80 shown is a hoop or ring 82 clampingly holding the bottle-cap 58 (FIG. 1) or, in the embodiment shown in FIG. 2, as having an inside diameter 84 just large enough to receive the capped end 86 of the nursing bottle 10 but desirably small enough as to retain the bottle 10 by supportingly engaging the larger diameter of the other portions 83 of the bottle 10.

(The interior opening 84 of support ring 82 is also, of course, large enough to accommodate passing therethrough of the nipple means 20; for it, via tube 14, is already connected to the nursing bottle 10 when the bottle is placed into the ring 82 of support means 80.)

Providing adjustable support for the ring 82, as may be desired to accommodate various associated support availability, the ring 82 is shown as supported by a ball-and-socket joint 86 to a sturdy clamp means shown as a clip 88 whose jaws 90 are adapted to supportingly engage any convenient support such as indicated at 92. (If desired, a locking means may be provided to maintain any set position of the movable joint 86.)

It is thus seen that a nursing bottle device for nursing an infant, according to the inventive concepts, provides a desired and advantageous device, yielding the advantages of a nursing bottle feeding without the parent having to hold the bottle, and without using the often-unsuccessful method of letting the bottle be held by the baby, or propped up by a blanket or some sort of toy or the like. Further, the invention provides an advantageous valve means, which is economical, easy to clean, and yet quite effective to prevent the baby sucking air after the milk supply of the nursing bottle is gone. The flexible tube, which holds the nipple means, permits the baby to nurse in various positions; yet as the infant turns during feeding, the bottle is still held sturdily in spite of the baby's movements, and without tipping over as happens by usual bottle-propping methods, and without the baby failing to hold the bottle correctly. And as well known, a baby starts to fret and cry when his or her feeding is interrupted, a bad mood which often continues even after the baby again is offered the nipple.

Accordingly, it will thus be seen from the foregoing description of the invention according to this illustrative embodment, considered with the accompanying drawings, that the present invention provides new and useful concepts of a novel and advantageous nursing bottle device having a remotely-connected nipple means, and a sturdy support for the bottle, and with the advantages of convenience, safety, and accommodation to the infant's wishes and capabilities, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

For example, for the closure means 30 of the nursing bottle 10, the disk 50 and the closure cap 58 may be formed integrally, yet still come within the concepts as shown and specified herein; and the tube-mounting posts 44 and 64 may be formed integrally with their respective carrying disks 40 and 50. Similarly, although the supporting attachment 80 is shown as having a clamp means 88, it could be provided in the form of a hook means which merely hooks over the top of an associated wall such as a crib wall, rather than having spring-jaw operativity. Also, although the term "milk" is used herein as the food or beverage being nursed by the infant, the term is meant to include whatever is the foodstuff dispensed. The word "disk" is used as to the valve member 70, although it is not to be considered to be limited to one of circular shape nor to a generally flat form. As used herein, the word "nursing bottle" refers to whatever is the container by which the baby's food is contained and dispersed, other names being "baby bottle," "feeding bottle," etc.; and no assertion of inventiveness is here made to the bottle or container itself.

What is claimed is:

1. An infant's nursing bottle device for nursing an infant, which provides a remotely-supplied nipple device for feeding an infant from an infant's nursing bottle, comprising, in combination:

a closure means for the nursing bottle;

an elongated and flexible connecting tube means;

a nipple means including a nipple;

first interconnection means which connects the tube means with the interior of the nipple means and provides communication of the interior of the tube means with the interior of the nipple means and of the nipple thereof;

second interconnection means, which includes the closure means for the nursing bottle and which connects the tube means with the nursing bottle and provides communication of the interior of the tube means with the interior of the nursing bottle;

bottle-support means being provided for supporting the nursing bottle in an inverted position and operatively remote from the location of the nipple means when the infant is nursing from the nipple of the nipple means;

in a combination in which valve means is provided which operatively seals the inlet of the second interconnection means, thereby blocking communication of the interior of the tube means with the interior of the nursing bottle and preventing passage of air from the bottle even through pressure in the tube means is less than in the bottle, when the milk supply in the nursing bottle has been exhausted.

2. The invention as set forth in claim 1, in a combination in which the valve means includes a floating disk means which is in the interior of the nursing bottle and provides the said sealing of the inlet of the second interconnection means, thereby blocking communication of the interior of the tube means with the interior of the nursing bottle, when the milk supply in the nursing bottle has been exhausted.

3. The invention as set forth in claim 2 in a combination in which the said floating disk means carries a valving member adapted to valvingly seat into the inlet of the second interconnection means, thereby blocking communication of the interior of the tube means with the interior of the nursing bottle, to thereby seal said inlet when the milk supply in the nursing bottle has been exhausted.

4. The invention as set forth in claim 3 in a combination in which the valving seating of the said valving member into said inlet is such as to retain that valving seating condition once it has been established, this being by one or both of the valving member and inlet being of resiliently deformable material and relatively sized so as to require some resilient deformation of one or both to effect said seating.

5. The invention as set forth in claim 4 in a combinaton in which the said valving member and the inlet are of such relative nature in shape and/or resilient deformability that a locking detent effect is achieved to effect said valve-retaining operativity once it has been established.

6. The invention as set forth in any one of claims 1 through 5, in a combination in which the nipple means comprises a disk, the nipple being secured to the disk, and provides between the walls of the nipple and the disk a milk chamber;

and the first interconnection means includes the disk and a hollow tube-mounting means carried thereby, opening to the milk chamber, the mounting means being adapted to supportingly and sealingly receive an end of the tube means, thereby providing an operatively sealed pathway route for the milk to flow from the tube means to the interior of the nipple of the nipple means.

7. An infant's nursing bottle device for nursing an infant, comprising, in combination:

a closure means for the nursing bottle;

delivery means for dispensing the contents of the bottle for consumption by the infant;

interconnection means, which includes the closure means for the nursing bottle and which connects the delivery means with the nursing bottle and provides communication of the interior of the delivery means with the interior of the nursing bottle;

in a combination in which valve means is provided which operatively seals the inlet of the interconnection means, thereby blocking communication of the interior of the delivery means with the interior of the nursing bottle and preventing passage of air from the bottle even though pressure in the delivery means is less than in the bottle, when the milk supply in the nursing bottle has been exhausted.

8. The invention as set forth in claim 7, in a combination in which the valve means includes a floating disk means which is in the interior of the nursing bottle and provides the said sealing of the inlet of the said interconnection means, thereby blocking communication of the interior of the tube means with the interior of the nursing bottle, when the milk supply in the nursing bottle has been exhausted.

9. The invention as set forth in claim 8, in a combination in which the said floating disk means carries a valving member adapted to valvingly seat into the inlet of the said interconnection means, thereby blocking communication of the interior of the tube means with the interior of the nursing bottle, to thereby seal said inlet when the milk supply in the nursing bottle has been exhausted.

10. The invention as set forth in claim 9, in a combination in which the valving seating of the said valving member into said inlet is such as to retain that valving seating condition once it has been established, this being by one or both of the valving member and inlet being of resiliently deformable material and relatively sized so as to require some resilient deformation of one or both to effect said seating.

11. The invention as set forth in claim 10 in a combination in which the said valving member and the inlet are of such relative nature in shape and/or resilient deformability that a locking detent effect is achieved to effect said valve-retaining operativity once it has been established.

* * * * *

UNITED STATES PATENT AND TRADEMARK OFFICE

CERTIFICATE OF CORRECTION

PATENT NO. : 4,301,934

DATED : November 24, 1981

INVENTOR(S) : Robert J. Forestal

It is certified that error appears in the above—identified patent and that said Letters Patent is hereby corrected as shown below:

Col. 1, line 22: The word "through" should be: -- throughout --.

Col. 1, line 41: The word "a" should be: -- the --.

Col. 2, line 18: The word "of" should be: -- to --.

Col. 2, line 64: The word "botle's" should be: -- bottle's --.

Col. 2, line 67: The word "opending" should be: -- opening --.

Col. 5, line 23: The word "through" should be: -- though --.

Signed and Sealed this

*Fourth* Day of *January 1983*

[SEAL]

*Attest:*

GERALD J. MOSSINGHOFF

*Attesting Officer*

*Commissioner of Patents and Trademarks*